US007357264B2

(12) United States Patent
Taguchi et al.

(10) Patent No.: US 7,357,264 B2
(45) Date of Patent: Apr. 15, 2008

(54) TRAIN HAVING ENERGY ABSORBING STRUCTURE BETWEEN CARS

(75) Inventors: Makoto Taguchi, Kobe (JP); Shinichi Okada, Kakogawa (JP); Seiichiro Yagi, Tarumi (JP); Hideyuki Yamaguchi, Akashi (JP)

(73) Assignee: Kawasaki Jukogyo Kabushiki Kaisha, Kobe-shi, Hyogo (JP)

( * ) Notice: Subject to any disclaimer, the term of this patent is extended or adjusted under 35 U.S.C. 154(b) by 62 days.

(21) Appl. No.: 10/478,790

(22) PCT Filed: Feb. 7, 2003

(86) PCT No.: PCT/JP03/01284

§ 371 (c)(1),
(2), (4) Date: Aug. 8, 2005

(87) PCT Pub. No.: WO03/068578

PCT Pub. Date: Aug. 21, 2003

(65) Prior Publication Data

US 2004/0168998 A1 Sep. 2, 2004

(30) Foreign Application Priority Data

Feb. 18, 2002 (JP) ..... 2002-039528

(51) Int. Cl.
*B61G 11/00* (2006.01)

(52) U.S. Cl. ..... 213/221

(58) Field of Classification Search ..... 213/7, 213/8, 9, 10, 40 R, 41, 75 R, 77, 220, 221
See application file for complete search history.

(56) References Cited

U.S. PATENT DOCUMENTS 2,636,621 A * 4/1953 Dean ..... 213/221
6,446,820 B1 * 9/2002 Barker et al. ..... 213/75 R
6,796,448 B1 * 9/2004 Wilt et al. ..... 213/40 R

FOREIGN PATENT DOCUMENTS

JP 2001-260881 A1 9/2001

OTHER PUBLICATIONS

International Search Report for International Applicatio No. PCT/JP03/01284 by the Japanese Patent Office dated Apr. 10, 2003.

* cited by examiner

*Primary Examiner*—S. Joseph Morano
*Assistant Examiner*—Robert J. McCarry, Jr.
(74) *Attorney, Agent, or Firm*—Marshall, Gerstein & Borun LLP

(57) ABSTRACT

In energy absorbing structures in an entire train, a compression amount at an interface between cars at an end portion of a train is reduced and compression at an interface between cars at a center portion of the train is facilitated. In the structure, a plurality of cars (A1 to A12) are coupled to one another through couplers (B1 to B11), and energy absorbing structures (S12 to S42, S82 to S122) are provided between cars. An average compressive load corresponding to a value obtained by dividing an energy absorption amount of the energy absorbing structure by a maximum compression amount of the energy absorbing structures (S12 to S42, S82 to S122) is set smaller at an interface between cars at a center portion of the train than at an interface between cars on an outer side of the train (closer to an end portion).

11 Claims, 9 Drawing Sheets

SPRING MASS POINT ANALYSIS MODEL

TRAIN HAVING ENERGY ABSORBING STRUCTURE BETWEEN CARS

TECHNICAL FIELD

The present invention relates to a train having an energy absorbing structure between cars. More particularly, the present invention relates to a train as a collective energy absorbing structure.

BACKGROUND ART

Conventionally, as shown in FIGS. 7, 8, and 9, a train, for example, a train 101 composed of twelve railway cars is configured such that a plurality of cars A1' to A12' are coupled to one another by means of couplers B1 to B11 each provided between the cars. And, energy absorbing elements that are tubular with rectangular cross-section are supported by a vehicle body frame, thereby forming energy absorbing structures. For example, as shown in FIGS. 8 and 9, in a front car and a subsequent car, energy absorbing elements 11' and 12' are placed in front of and behind buffing gears 13 and 14 coupled to couplers B1, respectively.

The applicant disclosed the above-described structure, in which bellows-like deformation stably takes place and the relationship between a width and a plate thickness of an impact absorbing member, i.e., an energy absorbing element satisfies a predetermined formula to reduce crash load and acceleration caused by crash between vehicle body frames (see Japanese Laid-Open Patent Application Publication No. 2001-334316). However, such a structure does not take best use of a collective structure of these energy absorbing structures of the entire train into consideration.

Conventionally, various types of energy absorbing structures between cars of the train have been proposed.

(1) The energy absorbing structure disclosed in Japanese Laid-Open Patent Application Publication No. Hei. 7-267086 is configured such that an annular member having a cylindrical outer surface is provided on one of a plurality of cars coupled to one another, and a support member having an inner cylindrical portion opposed to the cylindrical outer face is provided on an opposite car. The annular member and the support member are coupled by means of an annular coupling element, and an energy absorbing means is provided between them.

(2) The energy absorbing structure disclosed in Japanese Laid-Open Patent Application Publication No. 2000-313334 is configured to appropriately release a crash impact force that exceeds an upper limit of a mechanical strength of a coupler or a buffing gear to thereby reduce damage to the cars. For this purpose, a release mechanism for releasing a load acting on the buffing gear when the crash impact force that exceeds the upper limit of mechanical strength of the coupler or the buffing gear is generated, comprises a link mechanism having a variable spacing between the coupler and the buffing gear, and a restricting member capable of restricting an operation of the link mechanism when the impact force below the upper limit acts on the link mechanism and of releasing restriction of the operation when the impact force that exceeds the upper limit acts on the link mechanism.

(3) The energy absorbing structure disclosed in Japanese Laid-Open Patent Application Publication No. 2001-260881 comprises a buffing gear provided within a holder storage portion and an energy absorbing element provided between a rear end of the holder end and a rear stopper. Upon the crash impact force that exceeds the upper limit of mechanical strength of the coupler or the buffing gear acting on the car, in this energy absorbing structure, the holder slides to allow a crash energy to be absorbed by deformation of the energy absorbing element in order to reduce the damage to the car body.

(4) NEC TRAIN SETS—PRACTICAL CONSIDERATIONS FOR THE INTRODUCTION OF A CRASH ENERGY MANAGEMENT SYSTEM (Rail Vehicle Crashworthiness Symposium Jun. 24-26 1996) proposes a crash energy management system (see FIGS. 1 and 2 in the same literature document). In the crash energy management system, an energy absorption capacity at 1st interface between a front car and a subsequent car is set larger than an energy absorption capacity at 2nd interface between cars on the inner side of the train. The reason why the energy absorption capacity at the interface between the cars at an end portion of the train is set larger than the energy absorption capacity at the interface between the inner-side cars of the train is that the interface at the end portion of the train has subsequent cars more than the interface between the inner cars, and therefore needs to support more mass.

However, the prior arts disclosed in the above described Publications have the following problems.

(1) In the prior arts disclosed in Japanese Laid-Open Patent Application Publication Nos. 7-267086, 2000-313334, and 2001-260881, the energy absorbing structure between cars is provided at plural positions of the train, but a collective structure of these energy absorbing structures does not efficiently function.

(2) In the prior art disclosed in the literature document (crash energy management system), if a compressive load in energy absorption of the energy absorbing structure at the 1st interface is set smaller than that at the 2nd interface, then compressive deformation greatly occurs only at the 1st interface and the energy is not absorbed efficiently at the 2nd interface. As a result, the energy absorption capacity in the entire train is not sufficiently increased.

Since subsequent cars are fewer at the center portion of the train than at the front portion of the train, it is advantageous that the compressive load in energy absorption at the center portion is reduced, because this reduce impact acceleration in crash.

DISCLOSURE OF THE INVENTION

An object of the present invention is to provide a train as a collective energy absorbing structure in which compression at an interface between cars at an end portion of the train composed of a plurality of railway cars is reduced and compression at an interface between cars at a center portion of the train is facilitated, thereby achieving efficient crash energy absorption in the entire train.

The present invention provides a train having an energy absorbing structure between cars, comprising a plurality of cars coupled to one another; and energy absorbing structures each provided between cars, wherein an average compressive load which is obtained by dividing an energy absorption capacity of each energy absorbing structure by a maximum compression amount (maximum value of compression amount) of the energy absorbing structure is set smaller at an interface between cars at a center portion of the train than at an interface between cars closer to an end portion of the train. As defined herein, a configuration of "a train having an energy absorbing structure between cars" includes a configuration in which the energy absorbing structure is provided between end portions of the cars and the energy absorbing structure is provided an end portion of each car by coupling the structure to a coupler. Further, distinction is made between the interface between the cars at the center portion and the interface between cars on the outer side. This is because a railway vehicle is a two-way transportation means, and therefore is configured to travel in two ways.

In such a configuration, since the average compressive load of the energy absorbing structure between cars at the center portion of the train is smaller than the average compressive load at the interface between cars closer to the end portion of the train, the compressive deformation of the energy absorbing structure at the center portion of the train is facilitated, and the energy absorption at the center portion is increased. Thereby, the compression amount of the energy absorbing structure between cars at the end portion of the train is reduced, while the compression amount of the energy absorbing structure between cars at the center portion of the train is facilitated. As a result, the energy absorbing structures between cars over the entire train is efficiently used. Thus, the energy is absorbed by compression of the energy absorbing structure between cars properly in balance over the entire train.

Such well-balanced energy absorption over the entire train is easily accomplished by the configuration in which the energy absorbing structure between cars is comprised of an energy absorbing element and a support structure thereof, and one of or both of the number of the energy absorbing elements and a compressive load of the energy absorbing element is varied to allow the average compressive load to be smaller at the interface between cars at the center portion of the train than at the interface between cars closer to the end portion of the train.

And, preferably, the train comprises a plurality of cars coupled to one another; and energy absorbing structures each provided between cars, and an average compressive load which is obtained by dividing an energy absorption capacity of each energy absorbing structure by a maximum compression amount (maximum value of the compression amount) of the energy absorbing structure is set equal at interfaces between cars in an entire train, and at each interface between cars, an average compressive load of latter-half compression which is obtained by dividing an amount of an energy absorbed by the energy absorbing structure while the compression amount of the energy absorbing structure varies from a half compression amount that is half as large as a maximum compression amount to the maximum compression amount by the half compression amount, is set to a value of not less than a maximum compressive load generated while the compression amount of the energy absorbing structure varies from zero to the half compression amount of the maximum compression amount and a value of not more than an average compressive load of the energy absorbing structure at a front portion of a front car of the train.

In such a configuration, in the energy absorbing structure between cars of the train which is closer to the car which has crashed into another car (for example, front side), in a short time after the crash, the compression amount of the energy absorbing structure exceeds the half compression amount that is half as large as the maximum compression amount and reaches the latter-half compression, whereas behind the front side (away from the crash side), the compression amount does not reach the half compression amount of the maximum compression amount of the energy absorbing structure.

From the above, the average compressive load of the latter-half compression (from the half compression amount of the compression amount of the energy absorbing structure to the maximum compression amount) is set to a value of not less than the maximum compressive load generated in former-half compression (while the compression amount of the energy absorbing structure varies from zero to the half compression amount of the maximum compression amount) and a value of not more than the average compressive load of the energy absorbing structure at the front portion of the train. Thereby, the compressive load at the interface between subsequent cars can be substantially reduced.

Regarding crash of the front portion of the front car, time t required for the energy absorbing structure at the front portion of the front car to be compressed in crash between trains, is represented by:

$$t=(V1-V2)/A$$

where A is impact acceleration during deceleration of the front car, V1 is the speed before crash, and V2 is the speed after crash.

If the trains having the same configuration crash into each other, the trains having an equal mass crash into each other. Therefore, when restitution coefficient is zero (i.e., these trains are not away from each other and integral with each other after crash), from a law of conservation of momentum, the above formula is converted into:

$$V2=0.5V1$$

Therefore, $$t=0.5V1/A$$

Regarding crash between subsequent cars, in order to facilitate compression of the energy absorbing structure between the subsequent cars for the time t, the maximum value of the compressive load of the energy absorbing structure between cars in a range in which the compression amount reaches a value D1, needs to be set lower than a value of the average compressive load of the energy absorbing structure at the front portion.

And, assuming that the front car decelerates from the speed V1 to the speed V2=0.5V1 at deceleration A, and subsequent car decelerates from the speed V1 to a speed V3, the compression amount D1 for the time t is represented by:

$$\begin{aligned} D1 &= \{(V1+V3)/2-(V1+V2)/2\}\times t \\ &= 0.5\times(V3-0.5V1)\times t \\ &= 0.5\times(V3-0.5V1)\times 0.5V1/A \end{aligned}$$

After the time t when crash of the front car is completed and the speed reaches V2 (i.e., after the compression amount exceeds the value D1), the compressive load of the energy absorbing structure is increased to a value near the compressive load of the front car so that the impact acceleration of subsequent car becomes equal to substantially the impact acceleration A of the impact acceleration of the front car. And, regarding a compression amount D2 at the energy absorbing structure with the compressive load increased as described above, since time T required to complete the compression of this portion is represented by:

$$\begin{aligned} T &= (V3-V2)/A \\ &= (V3-0.5V1)/A, \end{aligned}$$

and the front car runs at a constant speed of V2, and subsequent car decelerates from the speed V1 to the speed V2 at deceleration A, $$D2 = \{(V3 + V2)/2 - V2\} \times T$$
$$= 0.5 \times (V3 - 0.5V1) \times (V3 - 0.5V1)/A$$

So, $$D1/(D1+D2)=0.5V1/V3=0.5/(V3/V1)$$

Since V3≦V1, V3/V1≦1

Therefore, D1/(D1+D2)≧0.5.

As should be appreciated from the above, by setting the compression amount D1 whose maximum compressive load should be set to the value lower than the average compressive load at the front portion to the value of not less than ½ of the maximum compression amount D (=D1+D2), the compression of subsequent car is facilitated. It should be noted that since the energy absorption capacity increases as the compression amount D1 decreases, the optimal value of D1 is given by: D1=0.5×D.

The average compressive load (average compressive load of the latter-half compression amount D2=0.5×D) in a range in which the compression amount of the energy absorbing structure between cars varies from the half compression amount of the maximum compression amount D (=D1+D2=2×D2) to the maximum compression amount is set to a value substantially equal to or slightly lower than the average compressive load at the front portion (i.e., the value of not more than the average compressive load of the energy absorbing structure at the front portion of the train), and the maximum compressive load of the former-half compression (maximum compressive load generated while the compression amount of the energy absorbing structure varies from zero to the half compression amount of the maximum compression amount is set to a value smaller than the average compressive load of the latter-half compression amount. Thereby, the compression amount at the front car is reduced and the compression of subsequent car is facilitated. As a result, the energy absorbing structures in the entire train can be efficiently used.

As described above, in order for the compressive load to vary stepwisely from the half compression amount that is half as large as the maximum compression amount as the boundary, it is preferable that the energy absorbing structure is comprised of a plurality of energy absorbing elements and support structures thereof, the plurality of energy absorbing elements are arranged in parallel to allow compressive loads in compressive deformation to be added to one another, and after one of the plurality of energy absorbing elements is compressed to a predetermined amount, another energy absorbing element starts to be compressively deformed.

The energy absorbing structure may be comprised of a plurality of energy absorbing elements with different compressive loads and support structures thereof, and the plurality of energy absorbing elements may be arranged in series. The "different compressive loads" is gained by, for example, changing the plate thickness of the energy absorbing element that is tubular with rectangular cross-section.

The energy absorbing structure is comprised of an energy absorbing element and a support structure thereof, and the energy absorbing element may have a characteristic in which compressive load increases stepwisely as compressive deformation progresses. This is achieved by integrating the plurality of energy absorbing elements into one energy absorbing element.

A train having an energy absorbing structure between cars may comprises a plurality of cars coupled to one another; and energy absorbing structures each provided between cars, wherein an average compressive load which is obtained by dividing an energy absorption capacity of each energy absorbing structure by a maximum compression amount of the energy absorbing structure is set smaller at an interface between cars at a center portion of the train than at an interface between cars closer to an end portion of the train, and the energy absorbing structure at least one interface is configured such that an average compressive load of latter-half compression which is obtained by dividing an amount of an energy absorbed by the energy absorbing structure while the compression amount of the energy absorbing structure varies from a half compression amount that is half as large as a maximum compression amount to the maximum compression amount by the half compression amount, is set to a value of not less than a maximum compressive load generated while the compression amount of the energy absorbing structure varies from zero to the half compression amount of the maximum compression amount and a value of not more than an average compressive load of the energy absorbing structure at the front portion of the train as a value obtained by dividing an energy absorption capacity of the energy absorbing structure at an end portion of the train by the compression amount of the energy absorbing structure at the end portion of the train.

In this case, as described above, the energy absorbing structure between cars is comprised of an energy absorbing element and a support structure thereof, and one of or both of the number of the energy absorbing elements and the compressive load of the energy absorbing element is varied to allow the average compressive load to be smaller at the interface between cars at the center portion of the train than at an interface between cars closer to the end portion of the train.

The energy absorbing structure at least one interface is configured such that a plurality of energy absorbing elements are arranged in parallel to allow compressive loads in compressive deformation to be added to one another, and after one of the plurality of energy absorbing elements is compressed to a predetermined amount, another energy absorbing elements starts to be compressively deformed.

The energy absorbing structure at least one interface may be configured such that a plurality of energy absorbing elements with different compressive loads are arranged in series.

The energy absorbing element of the energy absorbing structure at least one interface may have a characteristic in which a compressive load increases stepwisely as compressive deformation progresses.

By doing so, the energy absorbing structure may be achieved with a simple structure and fewer parts. In particular, it is advantageous that the impact absorbing member that is tubular with rectangular cross-section is added to an outer side of a main structure at an end portion of the car. Thereby, the average compressive load is varied at each interface between cars within one train, and the average compressive load of the latter-half compression from the half compression amount that is half as large as the maximum compression amount of the energy absorbing structure between cars is set to a value of not less than the maximum compressive load generated in a range where the compression amount of the energy absorbing structure varies from zero to the half compression amount of the maximum compression amount (former-half compression) and a value of not more than the average compressive load of the energy absorbing structure at the front portion of the train.

Hereinafter, an embodiment of the present invention will be described with reference to the drawings.

BEST MODE FOR CARRYING OUT THE INVENTION

Figure 1:
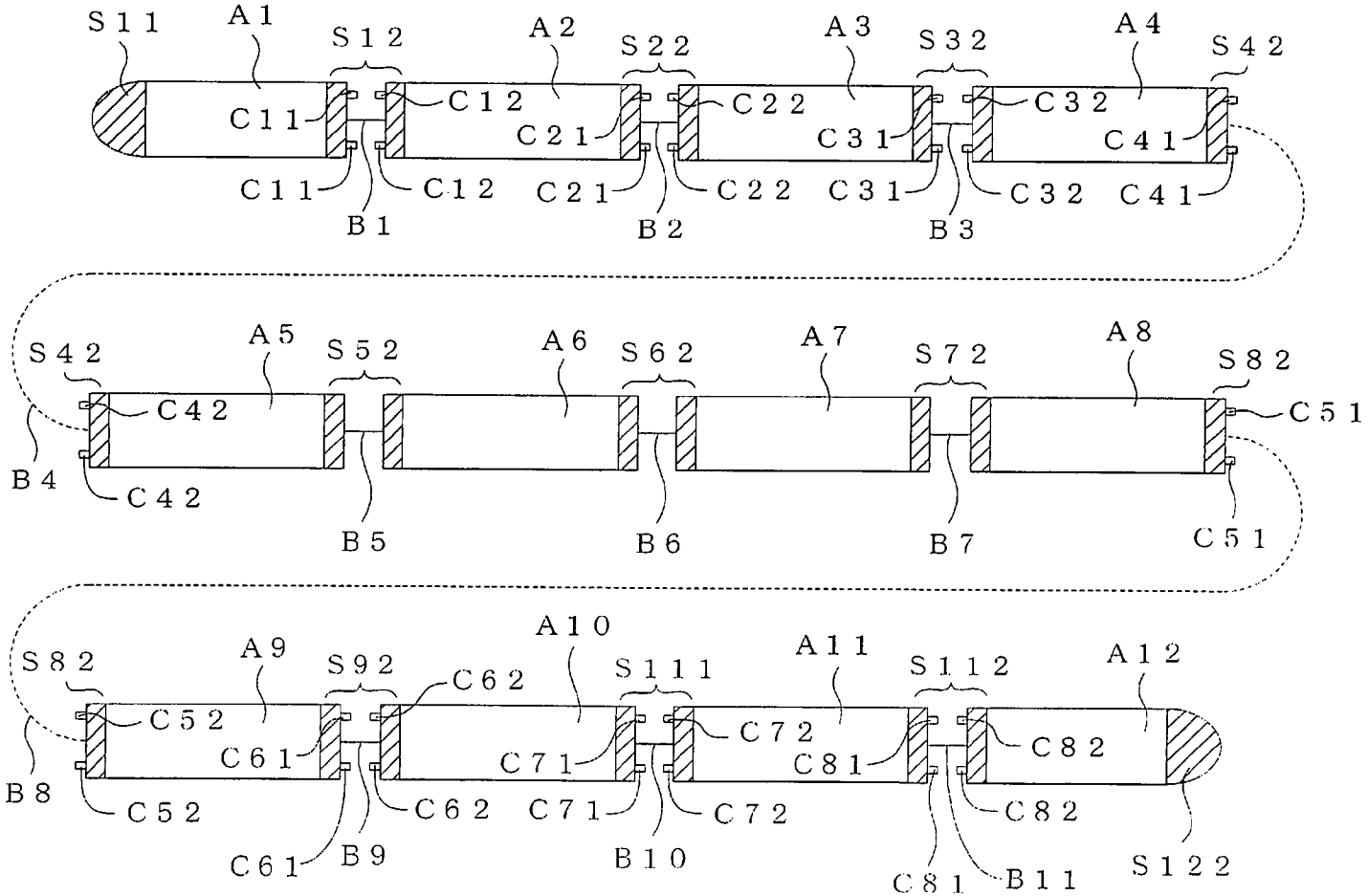
FIG. 1 is a view for explaining an example of a train according to the present invention.

FIG. 1 shows an example of a train of the present invention. The train comprises a plurality of cars A1 to A12 coupled to one another by means of couplers B1 to B11 provided between the cars and energy absorbing structures S12 to S112 provided between the cars. In addition, at end portions of the cars A1 and A12 forming end portions of the train, energy absorbing structures S11 and S122 are provided, respectively.

Figure 2:
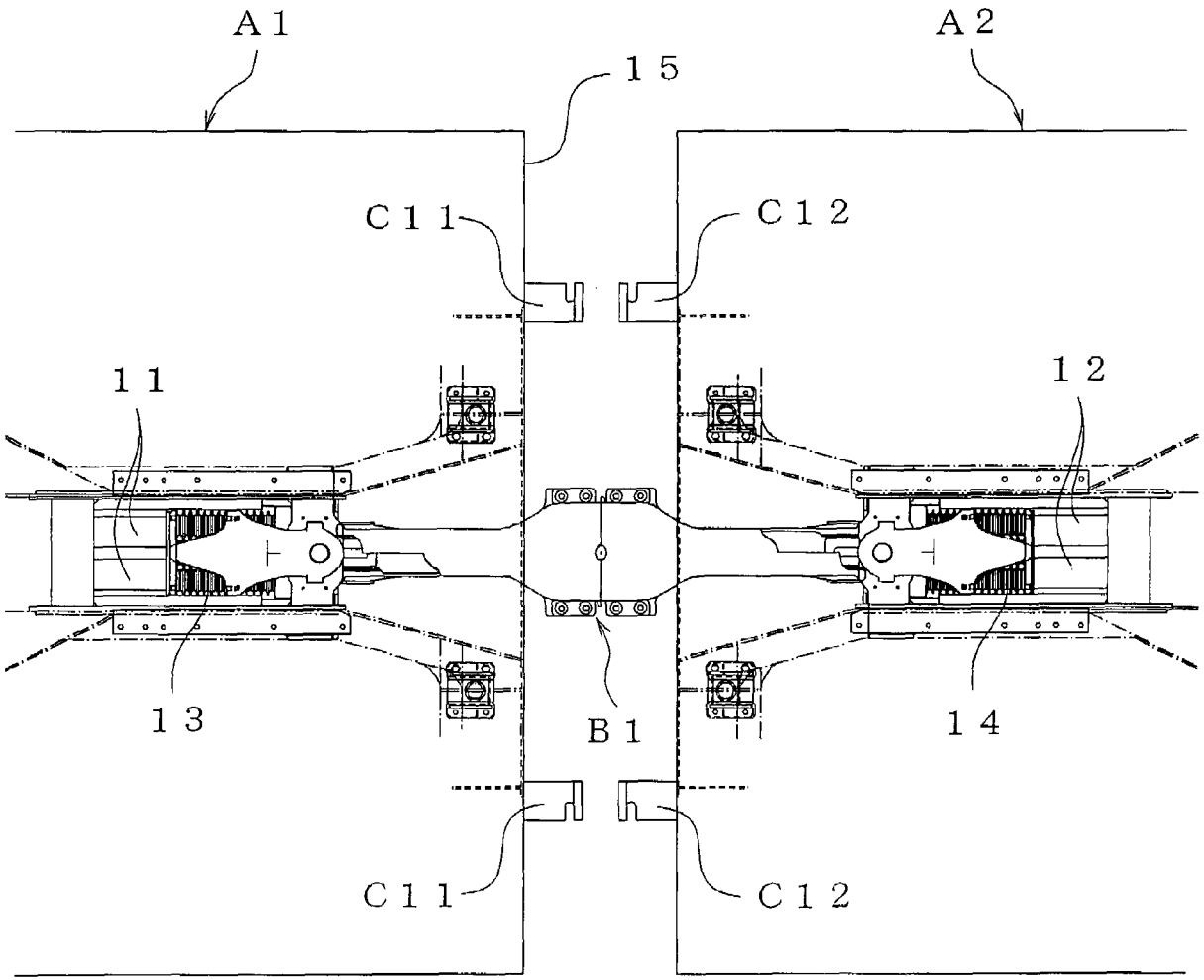
FIG. 2 is a plan view showing an example of an energy absorbing structure between cars (a coupling portion between a front car and a subsequent car) (at an end portion of the cars and between cars)) of the train according to the present invention.
Figure 3:
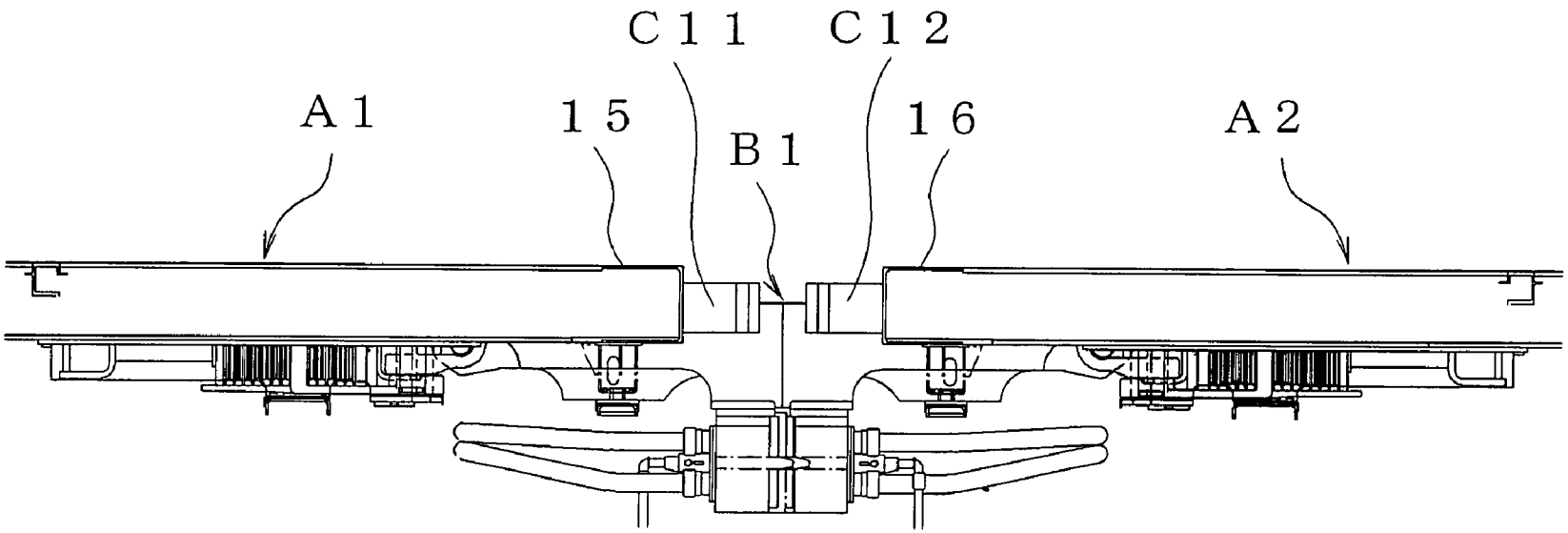
FIG. 3 is a side view of the energy absorbing structure in FIG. 2.

The energy absorbing structures (S12 to S42, S82 to S112) between first and second cars A1 and A2, from cars A2 to A5, and from cars A8 to A12 are structured as shown in FIGS. 2 and 3. Specifically, energy absorbing elements 11 and 12 are disposed in front of a buffing gear 13 of the car A1 and behind a buffing gear 14 of the car A2, respectively and are each supported by a draft lug as a support structure provided between center sills of a body frame. And, energy absorbing elements C11 and C12 are mounted by means of a body frame end portion as a support structure as opposed to each other so as to have a gap between tip ends thereof under the condition in which couplers B1 are coupled to each other. These energy absorbing elements are tubular with rectangular cross-section for allowing bellows-like deformation to be caused by crash, and are provided with slits which trigger the bellows-like deformation.

The plurality of energy absorbing elements 11, 12, C11, and C12 are arranged in parallel so that compressive loads during bellows-like deformation are added to one another. After any of the plurality of energy absorbing elements (in this example, energy absorbing elements 11 and 12) are compressed to a predetermined amount, the remaining energy absorbing elements C11 and C12 start to be compressively deformed. Specifically, in the construction in which the energy absorbing elements C11 and C12 are mounted to end beams of cars on front and rear sides as opposed to each other to have the gap between their tip ends, the energy absorbing elements 11 and 12 are compressed to a predetermined amount to cause the energy absorbing elements C11 and C12 to be brought into contact with each other, and then the energy absorbing elements C11 and C12 start to be compressively deformed.

Thereby, from a half compression amount that is half as large as a maximum compression amount of the energy absorbing structure between cars as a boundary, the compressive load of the energy absorbing structure can be varied stepwisely.

Subsequently, energy absorbing structures S52, S62, and S72 from the cars A5 to A8, will be described. These energy absorbing elements are not provided on the body frames but only on the draft lugs. For this reason, an average compressive load of the energy absorbing structure between cars (value obtained by dividing the energy absorption capacity of the energy absorbing structure by a maximum compression amount of the energy absorbing structure) is set so that the average compressive load between the cars at the center portion of the train is smaller than the average compressive load between cars closer to the end portions of the train (on outer side (on front and rear sides) of the center portion of the train).

In the above configuration, the compression amount at the center portion of the train is increased and hence, the energy absorption at the center portion is increased in contrast to the conventional construction. Thereby, part of the energy which is absorbed at the front car of the conventional train is absorbed at the center portion of the train. As a result, since burden of energy absorption on the front portion of the train is lessened, the compression at the interface between the cars at the front portion of the train is reduced, and hence, the energy is absorbed in proper balance over the entire length of the train without being absorbed only by part of the train.

Figure 4:
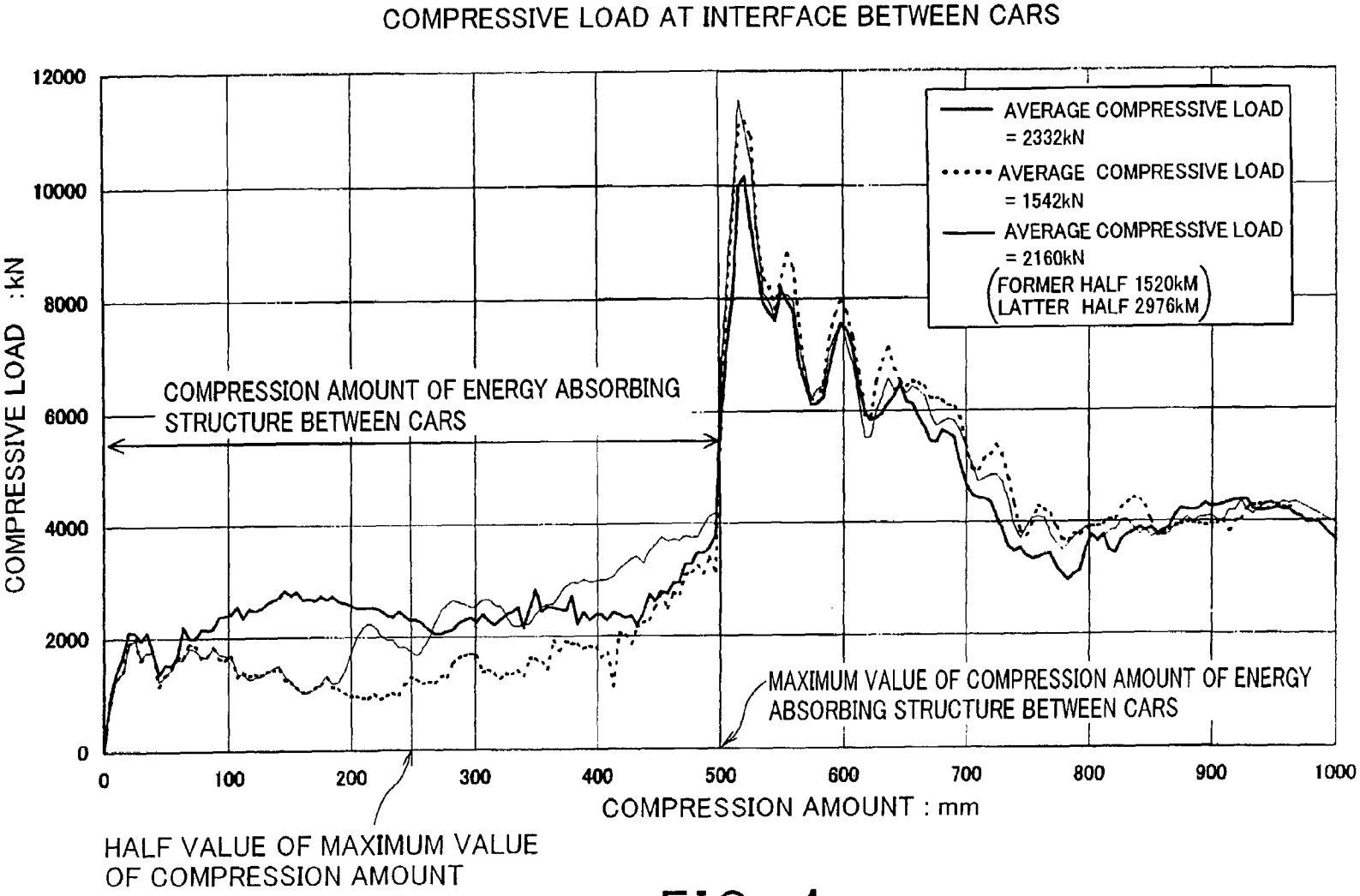
FIG. 4 is a view showing the relationship between a compression amount and a compressive load in the energy absorbing structure between cars.
Figure 8:
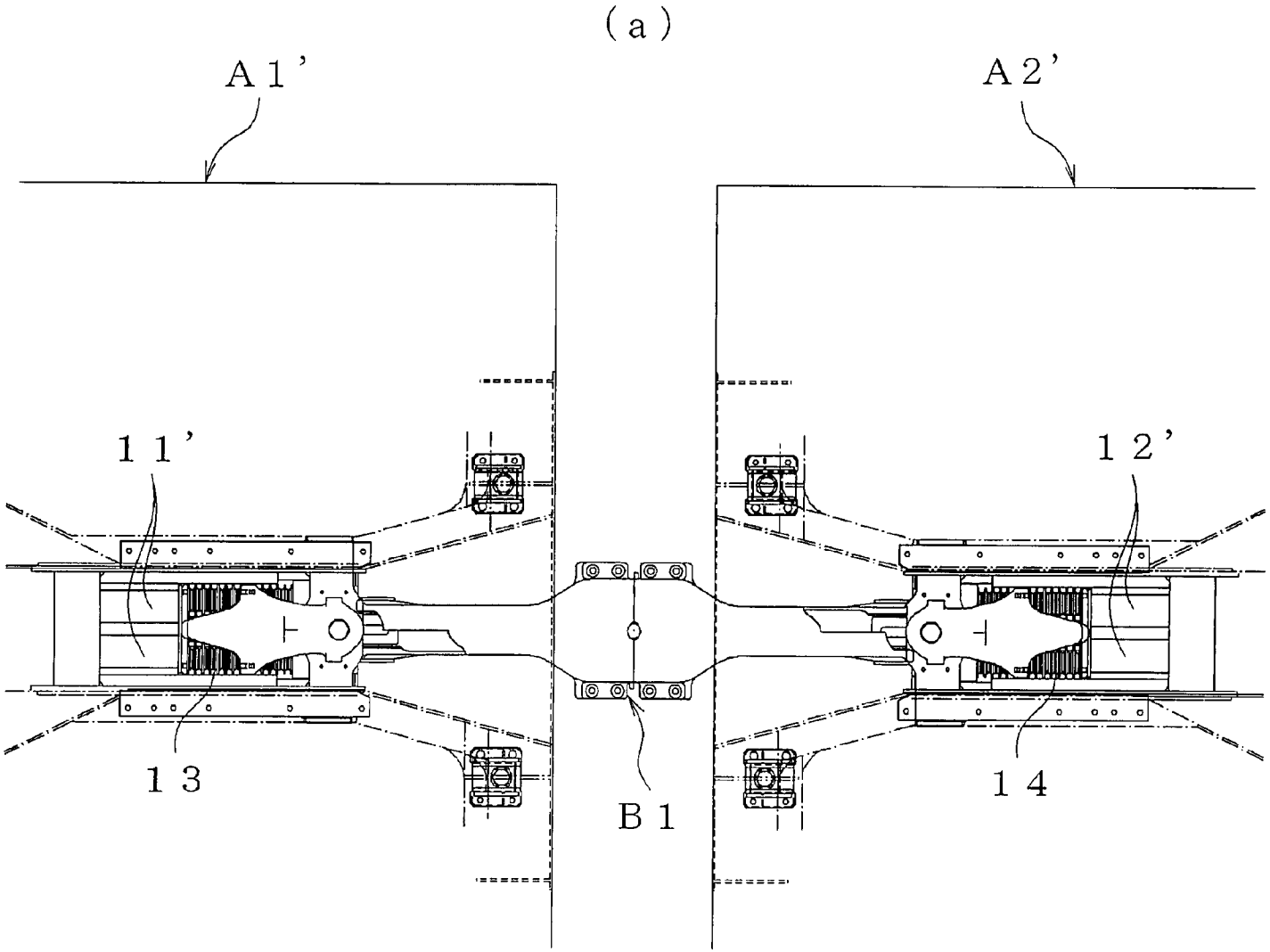
FIG. 8 is a plan view showing an example of the energy absorbing structure between cars in the conventional train.
Figure 9:
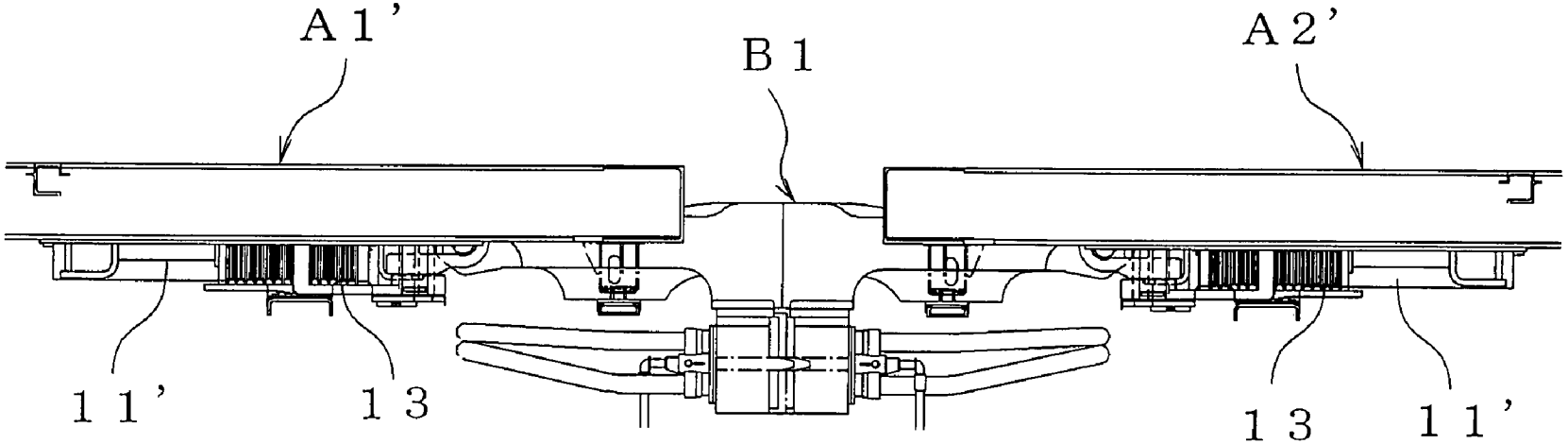
FIG. 9 is a side view of the energy absorbing structure in FIG. 8.

In FIG. 4, a thin line represents an analysis result of the relationship between the compressive load and the compression amount in the energy absorbing structures (S12 to S42, S82 to S112) between cars in FIGS. 2 and 3. In addition, in FIG. 4, a broken line represents an analysis result of the relationship between the compressive load and the compression amount in the energy absorbing structure between cars (prior art) in FIGS. 8 and 9 under the condition in which the plate thickness of the energy absorbing element is 6 mm, and a solid line represents an analysis result of the relationship between the compressive load and the compression amount in the energy absorbing structure in FIGS. 8 and 9 under the condition in which the plate thickness of the energy absorbing element is 9 mm. Regarding the energy absorbing structures shown in FIGS. 2 and 3, average compressive load of latter-half compression from a half compression amount that is half as large as a maximum compression amount of the energy absorbing structure between cars as a boundary, is equal to or slightly lower than an average compressive load (see FIG. 4) of the energy absorbing structure at the front portion of the front car, and a maximum compressive load of former-half compression is lower than the average compressive load of the latter-half compression.

By combining the energy absorbing structures in FIGS. 2, 3, 8 and 9 within the train, the average compressive load at the interface between the cars can be made smaller at the interface between cars at the center portion of the train than at the interface between cars closer to the end portion of the train. Further, the energy absorbing structure at one or more interfaces in all the energy absorbing structures is configured such that the average compressive load of the latter-half compression is set to a value of not more than the average compressive load of the energy absorbing structure at the front portion of the train, and the maximum compressive load of the former-half compression is set to a value lower than the average compressive load of the latter-half compression.

In the energy absorbing structures in FIGS. 2 and 3, the plurality of energy absorbing elements 11, 12, C11, and C12 are arranged in parallel so that compressive loads during compressive deformation are added to one another. After any of the energy absorbing elements are compressed to a predetermined amount, the remaining energy absorbing elements start to be compressively deformed. However, the present invention is not intended to be limited to this, but a plurality of energy absorbing elements having different compressive loads may be arranged in series. Alternatively, the plurality of energy absorbing elements may be integrated into one energy absorbing element so as to have a characteristic in which the compressive load increases stepwisely as the compressive deformation progresses.

Figure 5:
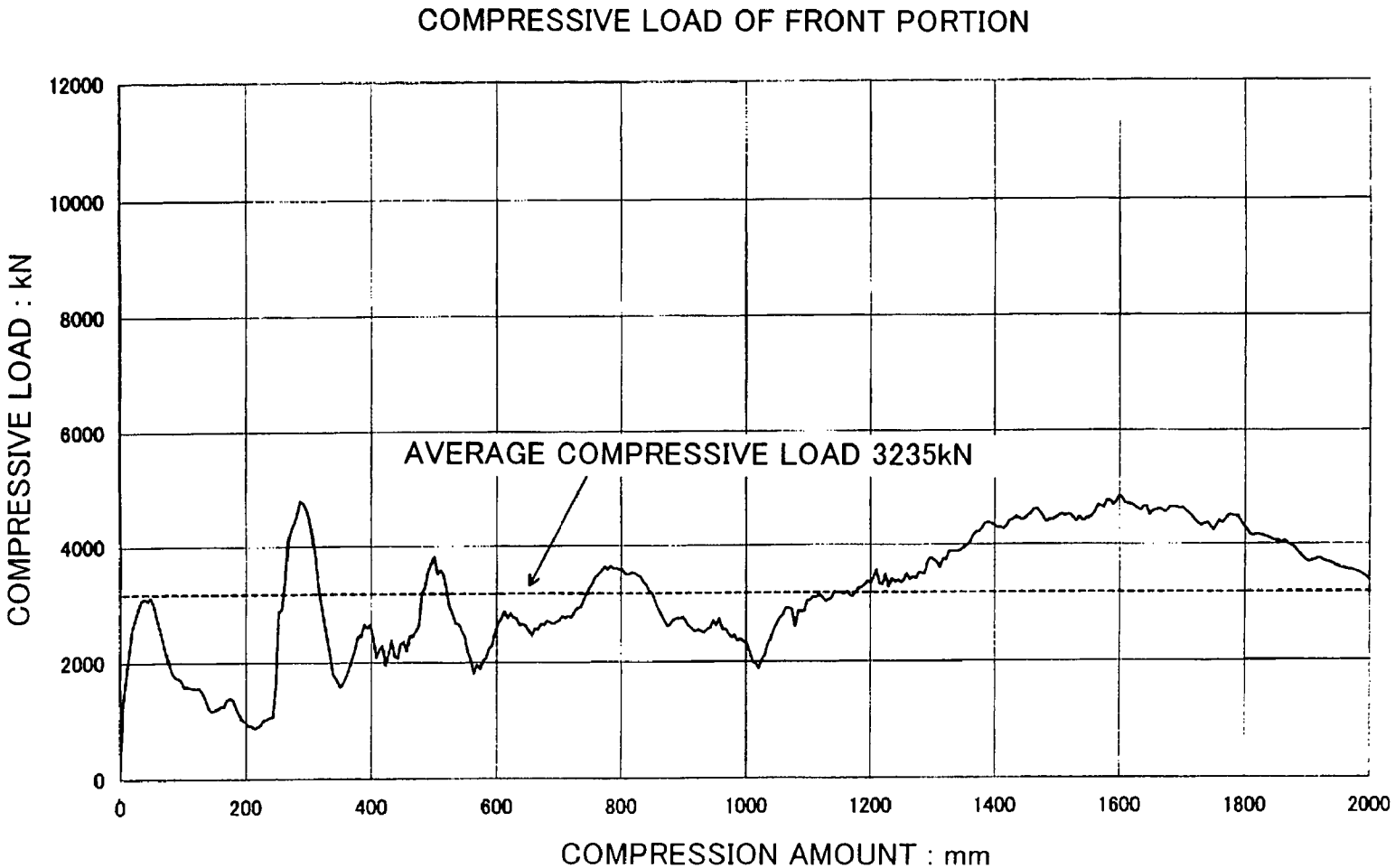
FIG. 5 is a view showing the relationship between a compression amount and a compressive load in the energy absorbing structure at the front car.

Subsequently, in order to confirm the effects of facilitating energy absorption between cars at the center portion of the train, analysis was conducted using the characteristics shown in FIGS. 4 and 5 for the following trains:

1) A train configured such that the average compressive load at the interface at the center portion of the train is smaller than that on its outer side (Example 1),
2) A train configured such that the average compressive loads at the interfaces are constant (equal), the average compressive load of the latter-half compression from the half compression amount of the maximum compression amount as the boundary at each interface, is equal to or slightly lower than the average compressive load of the energy absorbing structure at the front portion of the front car, and at each interface, the maximum compressive load of the former-half compression is lower than the average compressive load of the latter-half compression (Example 2),
3) A train configured such that the average compressive load at the interface at the center portion of the train is smaller than the average compressive load at the interface on its outer side (on front and rear sides), and the average compressive load of the latter-half compression from the half compression amount of the maximum compression amount as the boundary, is equal to or slightly lower than the average compressive load of the energy absorbing structure at the front portion of the front car, and the average maximum compressive load of the former-half compression is lower than the average compressive load of the latter-half compression (Example 3), and
4) The conventional train configured such that the average compressive load is equal at the interfaces in the entire train.

Figure 6:
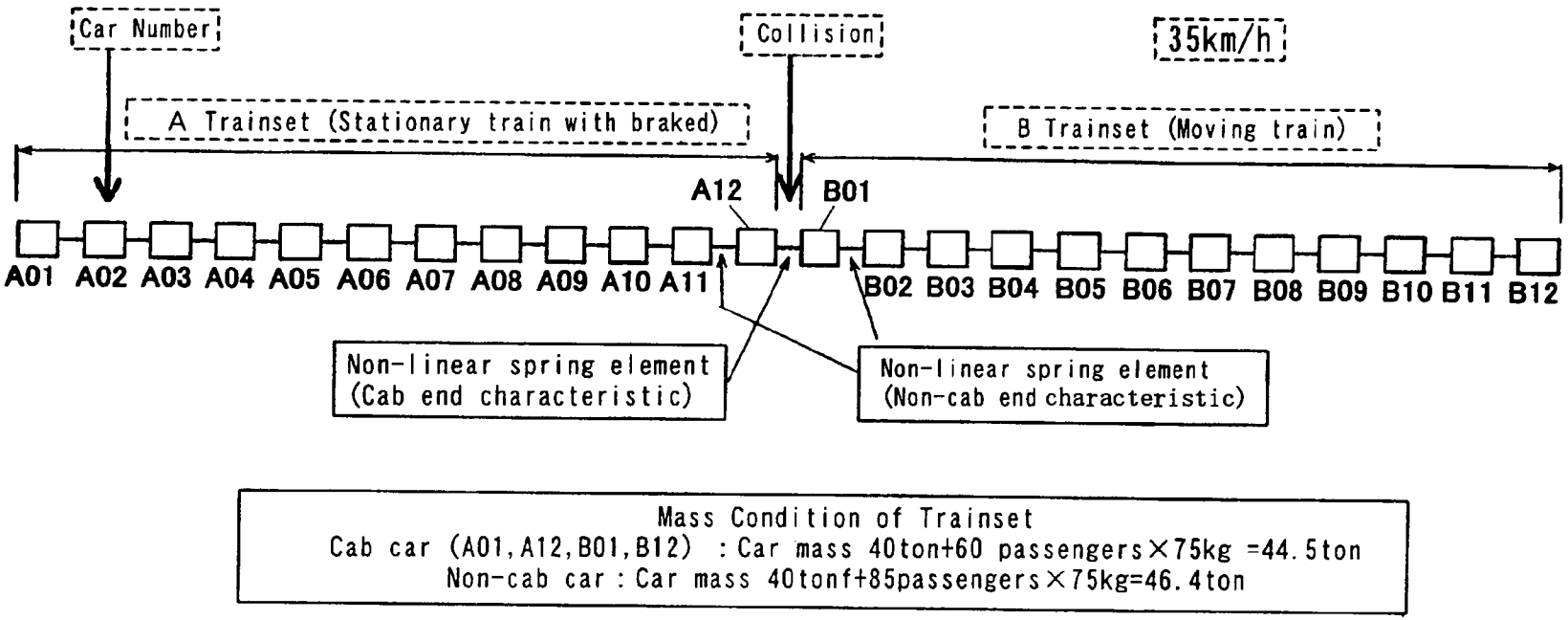
FIG. 6 is a view for explaining a spring mass point analysis model of the train of the present invention.
Figure 7:
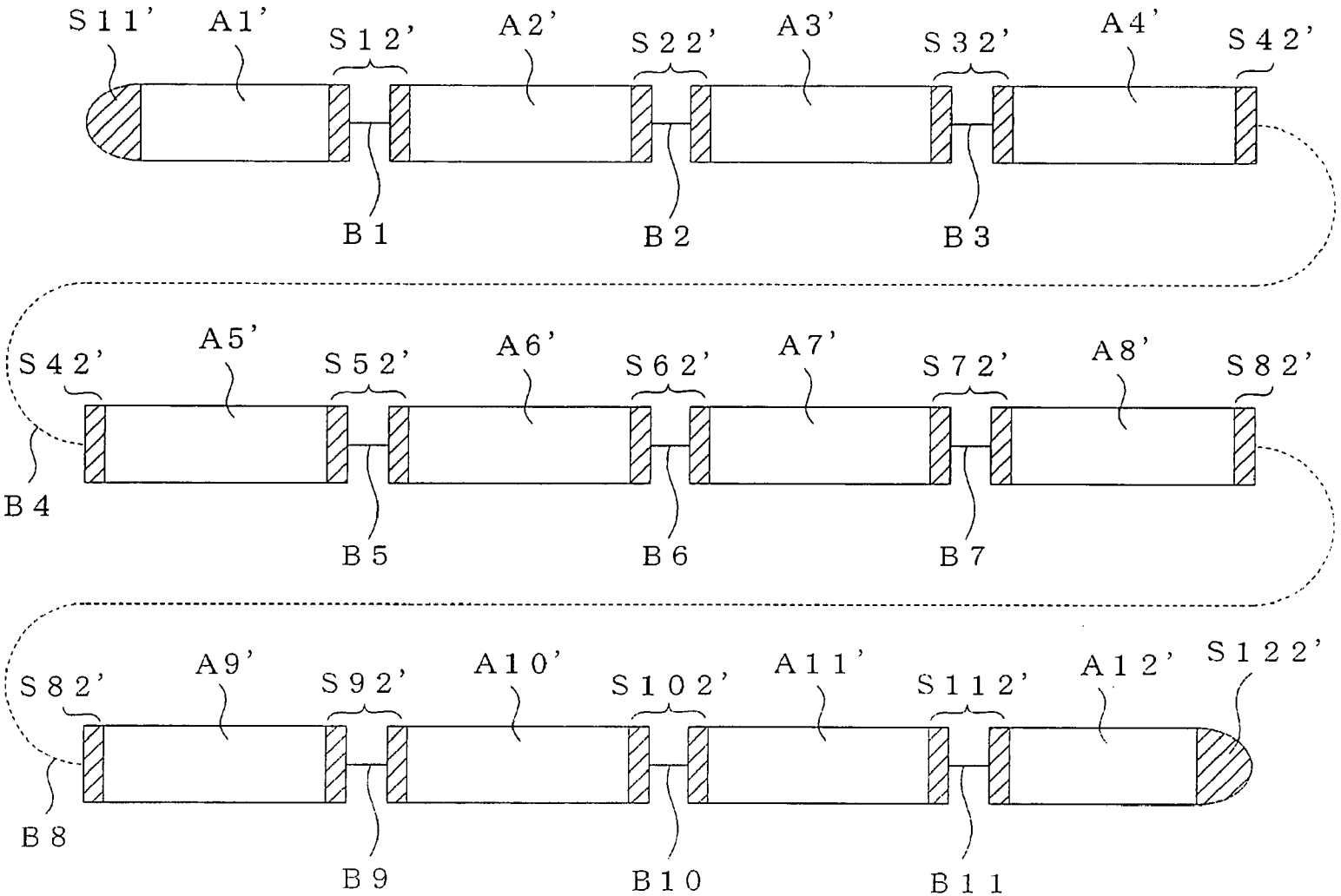
FIG. 7 is a view for explaining an example of the conventional train.

Here it is assumed that the above trains are running at 35 km/h and crash into another train having a similar configuration in a stopping state, and tables 1 to 6 show analysis results. Tables 1 and 4 show the analysis results of the train composed of 8 cars. Tables 2 and 5 show the analysis results of the train composed of 12 cars. Tables 3 and 6 show the analysis results of the train composed of 16 cars. The analysis was conducted by representing the compressive load characteristic at the front portion of the front car in FIG. 5 and the compressive load characteristic between cars in FIG. 4 by non-linear spring characteristic and using a model of a spring mass point system as shown in FIG. 6. Here, the average compressive load at the front portion is 3235kN.

TABLE 1

COMPARISON BETWEEN CONVENTIONAL STRUCTURE AND EXAMPLE OF THE PRESENT INVENTION IN TRAIN COMPOSED OF 8 CARS

| | AVERAGE COMPRESSIVE LOAD IN IMPACT ABSORBING STRUCTURE (UNIT: kN) | | | |
|---|---|---|---|---|
| | CONVENTIONAL STRUCTURE | EXAMPLE 1 | EXAMPLE 2 | EXAMPLE 3 |
| INTERFACE BETWEEN 1st AND 2nd CARS | 2332 | 2332 | 2160<br>FORMER HALF 1520<br>LATTER HALF 2976 | 2160<br>FORMER HALF 1520<br>LATTER HALF 2976 |
| INTERFACE BETWEEN 2nd AND 3rd CARS | 2332 | 2332 | 2160<br>FORMER HALF 1520<br>LATTER HALF 2976 | 2160<br>FORMER HALF 1520<br>LATTER HALF 2976 |
| INTERFACE BETWEEN 3rd AND 4th CARS | 2332 | 1542 | 2160<br>FORMER HALF 1520<br>LATTER HALF 2976 | 1542 |
| INTERFACE BETWEEN 4th AND 5th CARS | 2332 | 1542 | 2160<br>FORMER HALF 1520<br>LATTER HALF 2976 | 1542 |
| INTERFACE BETWEEN 5th AND 6th CARS | 2332 | 1542 | 2160<br>FORMER HALF 1520<br>LATTER HALF 2976 | 1542 |
| INTERFACE BETWEEN 6th AND 7th CARS | 2332 | 2332 | 2160<br>FORMER HALF 1520<br>LATTER HALF 2976 | 2160<br>FORMER HALF 1520<br>LATTER HALF 2976 |
| INTERFACE BETWEEN 7th AND 8th CARS | 2332 | 2332 | 2160<br>FORMER HALF 1520<br>LATTER HALF 2976 | 2160<br>FORMER HALF 1520<br>LATTER HALF 2976 |

TABLE 1-continued

COMPARISON BETWEEN CONVENTIONAL STRUCTURE AND EXAMPLE OF THE PRESENT INVENTION IN TRAIN COMPOSED OF 8 CARS

| | COMPRESSION AMOUNT IN CRASH (UNIT: mm) | | | | ABSORBED ENERGY IN CRASH (UNIT: MJ) | | | |
|---|---|---|---|---|---|---|---|---|
| | CONVENTIONAL STRUCTURE | EXAMPLE 1 | EXAMPLE 2 | EXAMPLE 3 | CONVENTIONAL STRUCTURE | EXAMPLE 1 | EXAMPLE 2 | EXAMPLE 3 |
| INTERFACE BETWEEN 1st AND 2nd CARS | 506 | 490 | 478 | 478 | 1.24 | 1.17 | 1.03 | 1.03 |
| INTERFACE BETWEEN 2nd AND 3rd CARS | 439 | 148 | 416 | 428 | 1.01 | 0.3 | 0.80 | 0.85 |
| INTERFACE BETWEEN 3rd AND 4th CARS | 100 | 498 | 396 | 484 | 0.18 | 0.8 | 0.75 | 0.75 |
| INTERFACE BETWEEN 4th AND 5th CARS | 63 | 326 | 249 | 242 | 0.1 | 0.44 | 0.38 | 0.4 |
| INTERFACE BETWEEN 5th AND 6th CARS | 24 | 31 | 38 | 22 | 0.03 | 0.04 | 0.06 | 0.03 |
| INTERFACE BETWEEN 6th AND 7th CARS | 23 | 20 | 26 | 22 | 0.03 | 0.02 | 0.03 | 0.02 |
| INTERFACE BETWEEN 7th AND 8th CARS | 20 | 20 | 20 | 20 | 0.02 | 0.02 | 0.02 | 0.02 |

TABLE 2

COMPARISON BETWEEN CONVENTIONAL STRUCTURE AND EXAMPLE OF THE PRESENT INVENTION IN TRAIN COMPOSED OF 12 CARS

| | AVERAGE COMPRESSIVE LOAD IN IMPACT ABSORBING STRUCTURE (UNIT: kN) | | | |
|---|---|---|---|---|
| | CONVENTIONAL STRUCTURE | EXAMPLE 1 | EXAMPLE 2 | EXAMPLE 3 |
| INTERFACE BETWEEN 1st AND 2nd CARS | 2332 | 2332 | 2160<br>FORMER HALF 1520<br>LATTER HALF 2976 | 2160<br>FORMER HALF 1520<br>LATTER HALF 2976 |
| INTERFACE BETWEEN 2nd AND 3rd CARS | 2332 | 2332 | 2160<br>FORMER HALF 1520<br>LATTER HALF 2976 | 2160<br>FORMER HALF 1520<br>LATTER HALF 2976 |
| INTERFACE BETWEEN 3rd AND 4th CARS | 2332 | 2332 | 2160<br>FORMER HALF 1520<br>LATTER HALF 2976 | 2160<br>FORMER HALF 1520<br>LATTER HALF 2976 |
| INTERFACE BETWEEN 4th AND 5th CARS | 2332 | 1542 | 2160<br>FORMER HALF 1520<br>LATTER HALF 2976 | 2160<br>FORMER HALF 1520<br>LATTER HALF 2976 |
| INTERFACE BETWEEN 5th AND 6th CARS | 2332 | 1542 | 2160<br>FORMER HALF 1520<br>LATTER HALF 2976 | 1542 |
| INTERFACE BETWEEN 6th AND 7th CARS | 2332 | 1542 | 2160<br>FORMER HALF 1520<br>LATTER HALF 2976 | 1542 |
| INTERFACE BETWEEN 7th AND 8th CARS | 2332 | 1542 | 2160<br>FORMER HALF 1520<br>LATTER HALF 2976 | 1542 |
| INTERFACE BETWEEN 8th AND 9th CARS | 2332 | 1542 | 2160<br>FORMER HALF 1520<br>LATTER HALF 2976 | 2160<br>FORMER HALF 1520<br>LATTER HALF 2976 |
| INTERFACE BETWEEN 9th AND 10th CARS | 2332 | 2332 | 2160<br>FORMER HALF 1520<br>LATTER HALF 2976 | 2160<br>FORMER HALF 1520<br>LATTER HALF 2976 |
| INTERFACE BETWEEN 10th AND 11th CARS | 2332 | 2332 | 2160<br>FORMER HALF 1520<br>LATTER HALF 2976 | 2160<br>FORMER HALF 1520<br>LATTER HALF 2976 |
| INTERFACE BETWEEN 11th AND 12th CARS | 2332 | 2332 | 2160<br>FORMER HALF 1520<br>LATTER HALF 2976 | 2160<br>FORMER HALF 1520<br>LATTER HALF 2976 |

TABLE 2-continued

COMPARISON BETWEEN CONVENTIONAL STRUCTURE AND EXAMPLE OF THE PRESENT INVENTION IN TRAIN COMPOSED OF 12 CARS

| | COMPRESSION AMOUNT IN CRASH (UNIT: mm) | | | | ABSORBED ENERGY IN CRASH (UNIT: MJ) | | | |
|---|---|---|---|---|---|---|---|---|
| | CONVENTIONAL STRUCTURE | EXAMPLE 1 | EXAMPLE 2 | EXAMPLE 3 | CONVENTIONAL STRUCTURE | EXAMPLE 1 | EXAMPLE 2 | EXAMPLE 3 |
| INTERFACE BETWEEN 1st AND 2nd CARS | 512 | 502 | 486 | 486 | 1.28 | 1.2 | 1.06 | 1.06 |
| INTERFACE BETWEEN 2nd AND 3rd CARS | 516 | 468 | 458 | 456 | 1.24 | 1.08 | 0.94 | 0.94 |
| INTERFACE BETWEEN 3rd AND 4th CARS | 502 | 180 | 468 | 468 | 1.22 | 0.26 | 0.98 | 0.98 |
| INTERFACE BETWEEN 4th AND 5th CARS | 238 | 496 | 444 | 442 | 0.54 | 0.8 | 0.90 | 0.90 |
| INTERFACE BETWEEN 5th AND 6th CARS | 120 | 496 | 396 | 482 | 0.22 | 0.8 | 0.74 | 0.74 |
| INTERFACE BETWEEN 6th AND 7th CARS | 97 | 452 | 284 | 408 | 0.18 | 0.66 | 0.45 | 0.58 |
| INTERFACE BETWEEN 7th AND 8th CARS | 33 | 68 | 86 | 26 | 0.06 | 0.12 | 0.13 | 0.04 |
| INTERFACE BETWEEN 8th AND 9th CARS | 25 | 33 | 26 | 26 | 0.04 | 0.06 | 0.04 | 0.04 |
| INTERFACE BETWEEN 9th AND 10th CARS | 24 | 19 | 22 | 22 | 0.04 | 0.02 | 0.04 | 0.04 |
| INTERFACE BETWEEN 10th AND 11th CARS | 22 | 20 | 21 | 21 | 0.02 | 0.02 | 0.02 | 0.02 |
| INTERFACE BETWEEN 11th AND 12th CARS | 20 | 19 | 21 | 21 | 0.02 | 0.02 | 0.02 | 0.02 |

TABLE 3

COMPARISON BETWEEN CONVENTIONAL STRUCTURE AND EXAMPLE OF THE PRESENT INVENTION IN TRAIN COMPOSED OF 16 CARS

| | AVERAGE COMPRESSIVE LOAD IN IMPACT ABSORBING STRUCTURE (UNIT: kN) | | | |
|---|---|---|---|---|
| | CONVENTIONAL STRUCTURE | EXAMPLE 1 | EXAMPLE 2 | EXAMPLE 3 |
| INTERFACE BETWEEN 1st AND 2nd CARS | 2332 | 2332 | 2160<br>FORMER HALF 1520<br>LATTER HALF 2976 | 2160<br>FORMER HALF 1520<br>LATTER HALF 2976 |
| INTERFACE BETWEEN 2nd AND 3rd CARS | 2332 | 2332 | 2160<br>FORMER HALF 1520<br>LATTER HALF 2976 | 2160<br>FORMER HALF 1520<br>LATTER HALF 2976 |
| INTERFACE BETWEEN 3rd AND 4th CARS | 2332 | 2332 | 2160<br>FORMER HALF 1520<br>LATTER HALF 2976 | 2160<br>FORMER HALF 1520<br>LATTER HALF 2976 |
| INTERFACE BETWEEN 4th AND 5th CARS | 2332 | 2332 | 2160<br>FORMER HALF 1520<br>LATTER HALF 2976 | 2160<br>FORMER HALF 1520<br>LATTER HALF 2976 |
| INTERFACE BETWEEN 5th AND 6th CARS | 2332 | 2332 | 2160<br>FORMER HALF 1520<br>LATTER HALF 2976 | 2160<br>FORMER HALF 1520<br>LATTER HALF 2976 |
| INTERFACE BETWEEN 6th AND 7th CARS | 2332 | 1542 | 2160<br>FORMER HALF 1520<br>LATTER HALF 2976 | 2160<br>FORMER HALF 1520<br>LATTER HALF 2976 |
| INTERFACE BETWEEN 7th AND 8th CARS | 2332 | 1542 | 2160<br>FORMER HALF 1520<br>LATTER HALF 2976 | 2160<br>FORMER HALF 1520<br>LATTER HALF 2976 |
| INTERFACE BETWEEN 8th AND 9th CARS | 2332 | 1542 | 2160<br>FORMER HALF 1520<br>LATTER HALF 2976 | 1542 |
| INTERFACE BETWEEN 9th AND 10th CARS | 2332 | 1542 | 2160<br>FORMER HALF 1520<br>LATTER HALF 2976 | 2160<br>FORMER HALF 1520<br>LATTER HALF 2976 |
| INTERFACE BETWEEN 10th AND 11th CARS | 2332 | 1542 | 2160<br>FORMER HALF 1520<br>LATTER HALF 2976 | 2160<br>FORMER HALF 1520<br>LATTER HALF 2976 |

TABLE 3-continued

COMPARISON BETWEEN CONVENTIONAL STRUCTURE AND EXAMPLE OF THE PRESENT INVENTION IN TRAIN COMPOSED OF 16 CARS

| | | | | |
|---|---|---|---|---|
| INTERFACE BETWEEN 11th AND 12th CARS | 2332 | 2332 | 2160<br>FORMER HALF 1520<br>LATTER HALF 2976 | 2160<br>FORMER HALF 1520<br>LATTER HALF 2976 |
| INTERFACE BETWEEN 12th AND 13th CARS | 2332 | 2332 | 2160<br>FORMER HALF 1520<br>LATTER HALF 2976 | 2160<br>FORMER HALF 1520<br>LATTER HALF 2976 |
| INTERFACE BETWEEN 13th AND 14th CARS | 2332 | 2332 | 2160<br>FORMER HALF 1520<br>LATTER HALF 2976 | 2160<br>FORMER HALF 1520<br>LATTER HALF 2976 |
| INTERFACE BETWEEN 14th AND 15th CARS | 2332 | 2332 | 2160<br>FORMER HALF 1520<br>LATTER HALF 2976 | 2160<br>FORMER HALF 1520<br>LATTER HALF 2976 |
| INTERFACE BETWEEN 15th AND 16th CARS | 2332 | 2332 | 2160<br>FORMER HALF 1520<br>LATTER HALF 2976 | 2160<br>FORMER HALF 1520<br>LATTER HALF 2976 |

| | COMPRESSION AMOUNT IN CRASH (UNIT: mm) | | | | ABSORBED ENERGY IN CRASH (UNIT: MJ) | | | |
|---|---|---|---|---|---|---|---|---|
| | CONVENTIONAL STRUCTURE | EXAMPLE 1 | EXAMPLE 2 | EXAMPLE 3 | CONVENTIONAL STRUCTURE | EXAMPLE 1 | EXAMPLE 2 | EXAMPLE 3 |
| INTERFACE BETWEEN 1st AND 2nd CARS | 512 | 510 | 492 | 491 | 1.29 | 1.28 | 1.08 | 1.08 |
| INTERFACE BETWEEN 2nd AND 3rd CARS | 510 | 506 | 474 | 472 | 1.28 | 1.24 | 1.02 | 1.00 |
| INTERFACE BETWEEN 3rd AND 4th CARS | 506 | 496 | 494 | 496 | 1.24 | 1.19 | 1.09 | 1.10 |
| INTERFACE BETWEEN 4th AND 5th CARS | 508 | 302 | 496 | 496 | 1.26 | 0.68 | 1.10 | 1.10 |
| INTERFACE BETWEEN 5th AND 6th CARS | 496 | 173 | 466 | 470 | 1.19 | 0.37 | 0.98 | 0.99 |
| INTERFACE BETWEEN 6th AND 7th CARS | 183 | 500 | 440 | 434 | 0.4 | 0.81 | 0.88 | 0.86 |
| INTERFACE BETWEEN 7th AND 8th CARS | 105 | 498 | 397 | 395 | 0.19 | 0.80 | 0.75 | 0.74 |
| INTERFACE BETWEEN 8th AND 9th CARS | 91 | 481 | 314 | 457 | 0.16 | 0.75 | 0.54 | 0.67 |
| INTERFACE BETWEEN 9th AND 10th CARS | 32 | 330 | 267 | 216 | 0.05 | 0.44 | 0.42 | 0.32 |
| INTERFACE BETWEEN 10th AND 11th CARS | 24 | 36 | 63 | 36 | 0.03 | 0.05 | 0.09 | 0.05 |
| INTERFACE BETWEEN 11th AND 12th CARS | 22 | 20 | 26 | 29 | 0.02 | 0.02 | 0.03 | 0.04 |
| INTERFACE BETWEEN 12th AND 13th CARS | 22 | 21 | 25 | 24 | 0.02 | 0.02 | 0.03 | 0.03 |
| INTERFACE BETWEEN 13th AND 14th CARS | 22 | 21 | 21 | 21 | 0.02 | 0.02 | 0.02 | 0.02 |
| INTERFACE BETWEEN 14th AND 15th CARS | 22 | 21 | 20 | 20 | 0.02 | 0.02 | 0.02 | 0.02 |
| INTERFACE BETWEEN 15th AND 16th CARS | 20 | 19 | 21 | 20 | 0.02 | 0.02 | 0.02 | 0.02 |

TABLE 4

COMPARISON OF IMPACT ACCELERATION IN EACH CAR-BETWEEN CONVENTIONAL STRUCTURE AND EXAMPLE OF THE PRESENT INVENTION IN TRAIN COMPOSED OF 8 CARS

| | CONVENTIONAL STRUCTURE | EXAMPLE 1 | EXAMPLE 2 | EXAMPLE 3 |
|---|---|---|---|---|
| 1st CAR | 6.4 gs | 4.1 gs | 4.7 gs | 4.6 gs |
| 2nd CAR | 5.0 gs | 3.1 gs | 4.3 gs | 4.3 gs |
| 3rd CAR | 3.7 gs | 3.7 gs | 3.4 gs | 3.4 gs |
| 4th CAR | 3.9 gs | 4.7 gs | 3.3 gs | 3.3 gs |
| 5th CAR | 3.8 gs | 3.3 gs | 2.9 gs | 2.8 gs |
| 6th CAR | 3.4 gs | 2.6 gs | 2.8 gs | 2.4 gs |
| 7th CAR | 4.0 gs | 2.8 gs | 2.9 gs | 2.9 gs |
| 8th CAR | 2.6 gs | 4.3 gs | 3.7 gs | 3.9 gs |

TABLE 5

COMPARISON OF IMPACT ACCELERATION IN EACH CAR BETWEEN CONVENTIONAL STRUCTURE AND EXAMPLE OF THE PRESENT INVENTION IN TRAIN COMPOSED OF 12 CARS

| | CONVENTIONAL STRUCTURE | EXAMPLE 1 | EXAMPLE 2 | EXAMPLE 3 |
|---|---|---|---|---|
| 1st CAR | 4.0 gs | 6.4 gs | 4.7 gs | 4.6 gs |
| 2nd CAR | 7.4 gs | 6.5 gs | 4.3 gs | 4.3 gs |
| 3rd CAR | 7.7 gs | 4.0 gs | 4.2 gs | 4.3 gs |
| 4th CAR | 3.9 gs | 3.9 gs | 4.8 gs | 4.8 gs |
| 5th CAR | 3.8 gs | 3.9 gs | 4.1 gs | 3.8 gs |
| 6th CAR | 4.8 gs | 5.2 gs | 3.1 gs | 3.5 gs |
| 7th CAR | 2.8 gs | 2.6 gs | 3.4 gs | 3.0 gs |
| 8th CAR | 2.6 gs | 3.2 gs | 3.3 gs | 3.4 gs |
| 9th CAR | 3.1 gs | 3.4 gs | 3.4 gs | 3.4 gs |

TABLE 5-continued

COMPARISON OF IMPACT ACCELERATION IN EACH CAR BETWEEN CONVENTIONAL STRUCTURE AND EXAMPLE OF THE PRESENT INVENTION IN TRAIN COMPOSED OF 12 CARS

| | CONVENTIONAL STRUCTURE | EXAMPLE 1 | EXAMPLE 2 | EXAMPLE 3 |
|---|---|---|---|---|
| 10th CAR | 3.4 gs | 3.8 gs | 3.0 gs | 3.0 gs |
| 11th CAR | 3.7 gs | 3.8 gs | 2.9 gs | 2.4 gs |
| 12th CAR | 4.2 gs | 3.5 gs | 3.7 gs | 3.6 gs |

TABLE 6

COMPARISON OF IMPACT ACCELERATION IN EACH CAR BETWEEN CONVENTIONAL STRUCTURE AND EXAMPLE OF THE PRESENT INVENTION IN TRAIN COMPOSED OF 16 CARS

| | CONVENTIONAL STRUCTURE | EXAMPLE 1 | EXAMPLE 2 | EXAMPLE 3 |
|---|---|---|---|---|
| 1st CAR | 9.5 gs | 4.7 gs | 4.7 gs | 4.6 gs |
| 2nd CAR | 7.4 gs | 8.0 gs | 4.3 gs | 4.3 gs |
| 3rd CAR | 10.4 gs | 8.0 gs | 4.2 gs | 4.3 gs |
| 4th CAR | 8.5 gs | 3.9 gs | 5.5 gs | 5.4 gs |
| 5th CAR | 7.1 gs | 4.9 gs | 5.5 gs | 5.4 gs |
| 6th CAR | 3.6 gs | 3.4 gs | 4.3 gs | 4.4 gs |
| 7th CAR | 3.4 gs | 3.7 gs | 3.5 gs | 3.5 gs |
| 8th CAR | 2.6 gs | 7.3 gs | 3.7 gs | 3.4 gs |
| 9th CAR | 4.2 gs | 4.4 gs | 4.1 gs | 3.4 gs |
| 10th CAR | 3.4 gs | 3.6 gs | 3.0 gs | 3.0 gs |
| 11th CAR | 3.7 gs | 3.6 gs | 2.8 gs | 2.5 gs |
| 12th CAR | 3.8 gs | 3.5 gs | 3.2 gs | 3.0 gs |
| 13th CAR | 3.8 gs | 3.0 gs | 3.4 gs | 3.2 gs |
| 14th CAR | 3.6 gs | 2.7 gs | 3.3 gs | 3.3 gs |
| 15th CAR | 3.1 gs | 2.7 gs | 3.1 gs | 3.1 gs |
| 16th CAR | 3.5 gs | 4.2 gs | 3.2 gs | 3.3 gs |

In the case of the train composed of 8 cars, as shown in Table 1, the compression amount of the energy absorbing structure between cars is above 500 mm corresponding to the maximum compression amount (maximum value of the compression amount) of the energy absorbing structure at one interface (interface between the first and second cars) in the conventional structure. When the compression amount reaches a value above the maximum compression amount of the corresponding energy absorbing structure, impact acceleration of 6.4 G at maximum as can be seen from Table 4, because the compressive load is rapidly increased (typically, the compressive load in an occupant volume is set high to protect the occupant volume). On the other hand, in the examples 1 to 3, the compression amount of the energy absorbing structure between cars at the center portion of the train is increased, and thereby the amount of energy absorbed at the center portion is increased. For this reason, the compression amount of the energy absorbing structure between cars on the side of the front portion of the train is reduced, and the compression amounts of the energy absorbing structures between cars in the entire train are not more than the maximum compression amount of the energy absorbing structure. As a result, in the examples 1 to 3, the impact acceleration is reduced to 4.7 G, 4.7 G, and 4.6 G.

Next, in the case of the train composed of 12 cars, as shown in Table 2, the compression amount of the energy absorbing structure between cars is above 500 mm corresponding to the maximum compression amount at three interfaces (interface between the first and second cars, interface between the second and third cars, and interface between the third and fourth cars) in the conventional structure, and impact acceleration as large as 7.7 G at maximum is generated as shown in Table 5. On the other hand, in the examples 1 to 3, the compression amount of the energy absorbing structure is above the maximum compression amount of the energy absorbing structure only at one interface between the first and second cars in the example 1. As a result, in the examples 1 to 3 of the present invention, the impact acceleration is significantly reduced to 6.5 G. 4.8 G, and 4.8 G.

Finally, in the case of the train composed of 16 cars, as shown in Table 3, the compression amount of the energy absorbing structure between cars is above 500 mm corresponding to the maximum compression amount of the energy absorbing structure at four interfaces (interface between the first and second cars, interface between the second and third cars, interface between the third and fourth cars, and interface between the fourth and fifth cars), and impact acceleration as large as 10.4 G at maximum is generated as shown in Table 6. On the other hand, in the examples 1 to 3 of the present invention, the compression amount of the energy absorbing structure between cars is above the maximum compression amount of the energy absorbing structure only at two interfaces in the example 1. As a result, in the examples 1 to 3 of the present invention, the impact acceleration is reduced to 8 G, 4.7 G, and 4.6 G.

In particular, in the third example, the impact acceleration is substantially equal to or slightly lower than that of the second example regardless of fewer energy absorbing elements.

INDUSTRIAL APPLICABILITY

In accordance with the present invention, since the average compressive load at the interface between cars at the center portion of the train is set smaller than the average compressive load at the interface between cars on its outer side, the compression at the interface at the center portion is facilitated, and the amount of energy absorbed at the center portion is increased. So, the compression amount at the interface at the end portion of the train can be reduced. Thus, the energy absorbing structure of the entire train can be efficiently used.

In addition, the average compressive load of the latter-half compression from the half compression amount of the maximum compression amount of the energy absorbing structure between cars as the boundary, is equal to or slightly lower than the average compressive load of the energy absorbing structure at the front portion of the front car, and the maximum compressive load of the former-half compression is lower than the average compressive load of the latter-half compression. In this configuration, since the compression amount of the energy absorbing structure at the interface which is closer to the leading car of the train which has crashed into another car, increases from the half compression amount of the maximum compression amount to the latter-half compression in a short time after crash, whereas, in the energy absorbing structure at the interface between the subsequent cars, the compression amount does not reach the half compression amount of the maximum compression amount. This means that the compressive load at the interface between subsequent cars is substantially reduced, and therefore the energy absorption at the center portion of the train can be increased.

The invention claimed is:

1. A train having an energy absorbing structure between cars comprising:

a plurality of cars coupled to one another to form a train having a pair of end portions and a central portion;

between-cars energy absorbing structures each provided between said cars;

a front portion energy absorbing structure provided at a front portion of at least one end car, wherein each of the between cars energy absorbing structures comprises a first energy absorbing assembly arranged in parallel with a second energy absorbing assembly, the second energy absorbing assembly comprising a gap between adjacent cars, the gap arranged such that the second energy absorbing assembly absorbs no loads until after the first energy absorbing assembly has compressed by a predetermined amount thereby eliminating the gap such that the second energy absorbing assembly begins to be compressively deformed;

the between cars energy absorbing structures in an entire train have a substantially same average compressive load;

the front portion energy absorbing structure has an average compressive load;

each of the between-cars energy absorbing structures has a maximum compressive load of former-half compression and an average compressive load of latter-half compression, the average compressive load of latter-half compression is set to a value of not less than the maximum compressive load of former-half compression and a value of not more than the average compressive load of the front portion energy absorbing structure;

the average compressive load is obtained by dividing an energy absorption capacity by a corresponding maximum compression amount;

the average compressive load of latter-half compression is obtained by dividing an amount of an energy absorbed by the between-cars energy absorbing structure varies from a half compression amount that is half as large as a maximum compression amount to the maximum compression amount by a corresponding compression amount which is the half compression amount; and the maximum compressive load of former-half compression is a maximum compressive load generated while the compression amount of the between-cars energy absorbing structure varies from zero to the half compression amount of the maximum compression amount.

2. The train according to claim 1, wherein the second energy absorbing assembly comprises a tubular-section, the tubular-section adapted for bellow-like deformation in response to a compressive load, and the tubular cross-section comprises slits adapted to trigger the bellows-like deformation in response to the compressive load.

3. The train according to claim 1, wherein the first energy absorbing assembly is operatively coupled to a coupler between adjacent cars.

4. The train according to claim 3, wherein the second energy absorbing assembly comprises a left assembly spaced to the left of the coupler and a right assembly spaced to the right of the coupler.

5. The train according to claim 1, wherein each car has a coupler for coupling the cars;

the first energy absorbing assembly is coupled in series with the coupler and comprised of a plurality of energy absorbing elements of different energy absorption characteristics coupled to each other in series.

6. The train according to claim 1, wherein each of the between-cars energy absorbing structures is comprised of an energy absorbing element and a support structure thereof, and the energy absorbing element has a characteristic in which compressive load increases stepwisely as compressive deformation progresses.

7. A train having an energy absorbing structure between cars comprising:

a plurality of cars coupled to one another to form a train having a pair of end portions and a central portion, at least one of the end portions including an end car;

between-cars energy absorbing structures each provided between cars adjacent a central portion of the train; and a front-portion energy absorbing structure provided at a front portion of the end car and having an average compressive load;

wherein the between-cars energy absorbing structures are arranged into a first set and a second set, the first set disposed at an interface between cars adjacent the central portion of the train and having a first average compressive load, and the second set disposed at an interface between cars adjacent the end portions of the train and having a second average compressive load, and the second set disposed at an interface between cars disposed adjacent the end cars of the train and having a second average compressive load, the second average compressive load less than the first average compressive load;

each of the between-cars energy absorbing structures of the second set comprises a first energy absorbing assembly arranged in parallel with a second energy absorbing assembly, the second energy absorbing assembly comprising a gap between adjacent cars, the gap arranged such that the second energy absorbing assembly absorbs no loads until after the first energy absorbing assembly has compressed by a predetermined amount thereby eliminating the gap such that the second energy absorbing assembly begins to be compressively deformed;

each of the between-cars energy absorbing structures having a maximum compressive load of former-half compression and an average compressive load of latter-half compression, the average compressive load of latter-half compression being set to a value of not less than the maximum compressive load of former-half compression and a value of not more than the average compressive load of the front portion energy absorbing structure;

wherein the average compressive loads for each type of energy absorbing structure is obtained by dividing an energy absorption capacity of each type of structure by a corresponding maximum compression amount of each type of structure;

the average compressive load of latter-half compression is obtained by dividing an amount of energy absorbed by the between-cars energy absorbing structure while a compression amount of the between-cars energy absorbing structure varies from a half compression amount that is half as large as a maximum compression amount to the maximum compression amount by a corresponding compression amount which is the half compression amount; and the maximum compressive load of former-half compression is a maximum compressive load generated while the compression amount of the between-cars energy absorbing structure varies from zero to the half compression amount of the maximum compression amount.

8. The train according to claim 7, wherein each of the between-cars energy absorbing structures is comprised of an energy absorbing element and a support structure thereof, and the energy absorbing element has a characteristic in which compressive load increases stepwisely as compressive deformation progresses.

9. The train according to claim 7, wherein each of the cars has a coupler for coupling the cars, the first energy absorbing assembly is coupled in series with the coupler and comprised of a plurality of energy absorbing elements of different energy absorption characteristics coupled to each other in series.

10. The train according to claim 7, wherein each of the cars has a coupler for coupling the cars, each between-cars energy absorbing structure of the first set coupled in series with the coupler and comprised of a plurality of energy absorbing elements of different energy absorption characteristics coupled to each other in series.

11. The train according to claim 7, wherein the second energy absorbing assembly comprises a tubular-section, the tubular-section adapted for bellow-like deformation in response to a compressive load, and the tubular cross-section comprises slits adapted to trigger the bellow-like deformation in response to the compressive load.

* * * * *